US007615144B2

(12) United States Patent
Devakottai et al.

(10) Patent No.: US 7,615,144 B2
(45) Date of Patent: Nov. 10, 2009

(54) HYDROCARBON THERMAL CRACKING USING HARDFACED FITTINGS

(75) Inventors: Bala S. Devakottai, Sugar Land, TX (US); Anthony R. Kiballa, Corpus Christi, TX (US); John A. Swanson, Pasadena, TX (US); Pinakin B. Mistry, Humble, TX (US)

(73) Assignee: Equistar Chemicals, LP, Houston, TX (US)

( * ) Notice: Subject to any disclaimer, the term of this patent is extended or adjusted under 35 U.S.C. 154(b) by 247 days.

(21) Appl. No.: 11/810,605

(22) Filed: Jun. 6, 2007

(65) Prior Publication Data

US 2008/0302702 A1 Dec. 11, 2008

(51) Int. Cl.
*C10G 9/14* (2006.01)

(52) U.S. Cl. ..... 208/132; 208/47; 208/130

(58) Field of Classification Search ..... 208/130, 208/132, 47; 585/648; 427/419.7
See application file for complete search history.

(56) References Cited

U.S. PATENT DOCUMENTS

| | | | | |
|---|---|---|---|---|
| 6,117,493 | A | 9/2000 | North | 427/419.7 |
| 6,743,961 | B2 | 6/2004 | Powers | 585/648 |
| 7,019,187 | B2 | 3/2006 | Powers | 585/648 |
| 2002/0043479 | A1 * | 4/2002 | Heyse et al. | 208/130 |
| 2005/0261530 | A1 * | 11/2005 | Stell et al. | 585/648 |

* cited by examiner

*Primary Examiner*—Walter D Griffin
*Assistant Examiner*—Renee Robinson
(74) *Attorney, Agent, or Firm*—Roderick W. MacDonald

(57) ABSTRACT

A thermal cracking process that employs (1) a sinusoidal conduit in the convection section of a thermal cracking furnace, (2) a cross-over conduit, and/or (3) a transfer conduit that contains at least one bend fitting, at least one bend fitting carrying a protective layer comprising a steel carrier and carbide pellets composed of submicron hard particles cemented with a metal binder.

6 Claims, 5 Drawing Sheets

HYDROCARBON THERMAL CRACKING USING HARDFACED FITTINGS

BACKGROUND OF INVENTION

1. Field of the Invention

This invention relates to the thermal cracking of hydrocarbons using a pyrolysis furnace having a convection section that contains at least one conduit that carries bend fittings and hard facing in at least one of the bend fittings. This invention is especially useful in processes that utilize, as a primary (initial) feedstock for an olefin production plant, heavier hydrocarbonaceous materials that contain solid particles and/or tend to form coke in the convection section of a pyrolysis furnace, particularly, but not exclusively, whole crude oil and/or natural gas condensate feeds.

2. Description of the Prior Art

Thermal cracking (pyrolysis) of hydrocarbons is a petrochemical process that is widely used to produce olefins such as ethylene, propylene, butenes, butadiene, and aromatics such as benzene, toluene, and xylenes.

Basically, a hydrocarbon containing feedstock is mixed with steam which serves as a diluent to keep the hydrocarbon molecules separated. The steam/hydrocarbon mixture is preheated in the convection zone of the furnace to from about 900 to about 1,000 degrees Fahrenheit (F), and then enters the reaction (radiant) zone where it is very quickly heated to a severe hydrocarbon thermal cracking temperature in the range of from about 1,450 to about 1,550 F. Thermal cracking is accomplished without the aid of any catalyst.

This process is carried out in a pyrolysis furnace (steam cracker) at pressures in the reaction zone ranging from about 10 to about 30 psig. Pyrolysis furnaces have internally thereof a convection section (zone) and a separate radiant section (zone). Preheating functions are primarily accomplished in the convection section, while severe cracking mostly occurs in the radiant section.

After thermal cracking, depending on the nature of the primary feed to the pyrolysis furnace, the effluent from that furnace can contain gaseous hydrocarbons of great variety, e.g., from one to thirty-five carbon atoms per molecule. These gaseous hydrocarbons can be saturated, monounsaturated, and polyunsaturated, and can be aliphatic, alicyclics, and/or aromatic. The cracked gas can also contain significant amounts of molecular hydrogen (hydrogen).

The cracked product is then further processed in the olefin production plant to produce, as products of the plant, various separate individual streams of high purity such as hydrogen, ethylene, propylene, mixed hydrocarbons having four carbon atoms per molecule, fuel oil, and pyrolysis gasoline. Each separate individual stream aforesaid is a valuable commercial product in its own right. Thus, an olefin production plant currently takes a part (fraction) of a whole crude stream or condensate, and generates therefrom a plurality of separate, valuable products.

Thermal cracking came into use in 1913 and was first applied to gaseous ethane as the primary feed to the cracking furnace for the purpose of making ethylene. Since that time the industry has evolved to using heavier and more complex hydrocarbonaceous gaseous and/or liquid feeds as the primary feed for the cracking furnace. Such feeds can now employ a fraction of whole crude or condensate which is essentially totally vaporized while thermally cracking same. The cracked product can contain, for example, about 1 weight percent (wt. %) hydrogen, about 10 wt. % methane, about 25 wt. % ethylene, and about 17 wt. % propylene, all wt. % being based on the total weight of that product, with the remainder consisting mostly of other hydrocarbon molecules having from 4 to 35 carbon atoms per molecule.

Natural gas and whole crude oil(s) were formed naturally in a number of subterranean geologic formations (formations) of widely varying porosities. Many of these formations were capped by impervious layers of rock. Natural gas and whole crude oil (crude oil) also accumulated in various stratigraphic traps below the earth's surface. Vast amounts of both natural gas and/or crude oil were thus collected to form hydrocarbon bearing formations at varying depths below the earth's surface. Much of this natural gas was in close physical contact with crude oil, and, therefore, absorbed a number of lighter molecules from the crude oil.

When a well bore is drilled into the earth and pierces one or more of such hydrocarbon bearing formations, natural gas and/or crude oil can be recovered through that well bore to the earth's surface.

The terms "whole crude oil" and "crude oil" as used herein means liquid (at normally prevailing conditions of temperature and pressure at the earth's surface) crude oil as it issues from a wellhead separate from any natural gas that may be present, and excepting any treatment such crude oil may receive to render it acceptable for transport to a crude oil refinery and/or conventional distillation in such a refinery. This treatment would include such steps as desalting. Thus, it is crude oil that is suitable for distillation or other fractionation in a refinery, but which has not undergone any such distillation or fractionation. It could include, but does not necessarily always include, non-boiling entities such as asphaltenes or tar. As such, it is difficult if not impossible to provide a boiling range for whole crude oil. Accordingly, whole crude oil could be one or more crude oils straight from an oil field pipeline and/or conventional crude oil storage facility, as availability dictates, without any prior fractionation thereof.

Natural gas, like crude oil, can vary widely in its composition as produced to the earth's surface, but generally contains a significant amount, most often a major amount, i.e., greater than about 50 weight percent (wt. %), methane. Natural gas often also carries minor amounts (less than about 50 wt. %), often less than about 20 wt. %, of one or more of ethane, propane, butane, nitrogen, carbon dioxide, hydrogen sulfide, and the like. Many, but not all, natural gas streams as produced from the earth can contain minor amounts (less than about 50 wt. %), often less than about 20 wt. %, of hydrocarbons having from 5 to 12, inclusive, carbon atoms per molecule (C5 to C12) that are not normally gaseous at generally prevailing ambient atmospheric conditions of temperature and pressure at the earth's surface, and that can condense out of the natural gas once it is produced to the earth's surface. All wt. % are based on the total weight of the natural gas stream in question.

When various natural gas streams are produced to the earth's surface, a hydrocarbon composition often naturally condenses out of the thus produced natural gas stream under the then prevailing conditions of temperature and pressure at the earth's surface where that stream is collected. There is thus produced a normally liquid hydrocarbonaceous condensate separate from the normally gaseous natural gas under the same prevailing conditions. The normally gaseous natural gas can contain methane, ethane, propane, and butane. The normally liquid hydrocarbon fraction that condenses from the produced natural gas stream is generally referred to as "condensate," and generally contains molecules heavier than butane (C5 to about C20 or slightly higher). After separation from the produced natural gas, this liquid condensate fraction is processed separately from the remaining gaseous fraction that is normally referred to as natural gas.

Thus, condensate recovered from a natural gas stream as first produced to the earth's surface is not the exact same material, composition wise, as natural gas (primarily methane). Neither is it the same material, composition wise, as crude oil. Condensate occupies a niche between normally gaseous natural gas and normally liquid whole crude oil. Condensate contains hydrocarbons heavier than normally gaseous natural gas, and a range of hydrocarbons that are at the lightest end of whole crude oil.

Condensate, unlike crude oil, can be characterized by way of its boiling point range. Condensates normally boil in the range of from about 100 to about 650 F. With this boiling range, condensates contain a wide variety of hydrocarbonaceous materials. These materials can include compounds that make up fractions that are commonly referred to as naphtha, kerosene, diesel fuel(s), and gas oil (fuel oil, furnace oil, heating oil, and the like). Naphtha and associated lighter boiling materials (naphtha) are in the C5 to C10, inclusive, range, and are the lightest boiling range fractions in condensate, boiling in the range of from about 100 to about 400 F. Petroleum middle distillates (kerosene, diesel, atmospheric gas oil) are generally in the C10 to about C20 or slightly higher range, and generally boil, in their majority, in the range of from about 350 to about 650 F. They are, individually and collectively, referred to herein as "distillate" or "distillates." Distillate compositions can have a boiling point lower than 350 F and/or higher than 650 F, and such distillates are included in the 350-650 F range aforesaid, and in this invention.

The olefin production industry is now progressing beyond the use of fractions of crude oil or condensate (gaseous and/or liquid) as the primary feed for a cracking furnace to the use of whole crude oil and/or condensate itself.

Recently, U.S. Pat. No. 6,743,961 (hereafter "U.S. Pat. No. '961") issued to Donald H. Powers. This patent relates to cracking whole crude oil by employing a vaporization/mild cracking zone that contains packing. This zone is operated in a manner such that the liquid phase of the whole crude that has not already been vaporized is held in that zone until cracking/vaporization of the more tenacious hydrocarbon liquid components is maximized. This allows only a minimum of solid residue formation which residue remains behind as a deposit on the packing. This residue is later burned off the packing by conventional steam air decoking, ideally during the normal furnace decoking cycle, see column 7, lines 50-58 of that patent. Thus, the second zone 9 of that patent serves as a trap for components, including hydrocarbonaceous materials, of the crude oil feed that cannot be cracked or vaporized under the conditions employed in the process, see column 8, lines 60-64 of that patent.

Still more recently, U.S. Pat. No. 7,019,187 issued to Donald H. Powers. This patent is directed to the process disclosed in U.S. Pat. No. '961, but employs a mildly acidic cracking catalyst to drive the overall function of the vaporization/mild cracking unit more toward the mild cracking end of the vaporization (without prior mild cracking)—mild cracking (followed by vaporization) spectrum.

The disclosures of the foregoing patents, in their entirety, are incorporated herein by reference.

Coke, as used herein, means a high molecular weight carbonaceous solid, and includes compounds formed from the condensation of polynuclear aromatics. Coke has heretofore been found to be formed essentially only in the radiant section of furnaces where the primary cracking of the furnace feed occurs.

Heretofore, little or no coke was found in the convection sections of cracking furnaces, and it was common thought in the industry that erosion protection in the convection section of furnaces was not necessary. However, it has been found that as the industry has progressed to the cracking of heavier and more complex feeds, the tendency to form coke in the convection section of a furnace has increased. This tendency to form coke in the convection section of a furnace, because of its primarily preheating function, was unexpected. Further, this coke formation tendency can increase even more as the industry moves toward using whole crude oil and/or condensate as a primary furnace feed.

It has recently been found that with an increased tendency to (1) form coke in the convection section of a furnace and (2) carry solid particles such as sand and asphaltenes into the furnace by way of heavier feedstocks, erosion of fittings in the convection section tubing, cross-over line, and/or transfer line has increased. For example, in a convection section conduit (line), cracking feed can pass there through at a velocity of from about 250 to about 700 feet per second. This high velocity cracking feed carrying solid particles and/or coke particles can cause substantial erosion of convection section conduits, particularly when a stream of feed carrying such particles is changed in its direction of flow by impinging same on a 90 degree elbow fitting, a 180 degree u-tube fitting, and the like, as explained in greater detail hereinafter.

This invention addresses the unexpected problem of erosion in the convection section of cracking furnaces as well as crossover lines and transfer lines.

SUMMARY OF THE INVENTION

In accordance with this invention, erosion in the convection section of a cracking furnace, crossover line, and/or transfer line is at least reduced, if not eliminated, by employing therein a hard facing comprising a steel carrier and carbide pellets composed of submicron hard particles cemented with a metal binder.

DETAILED DESCRIPTION OF THE INVENTION

Figure 1:
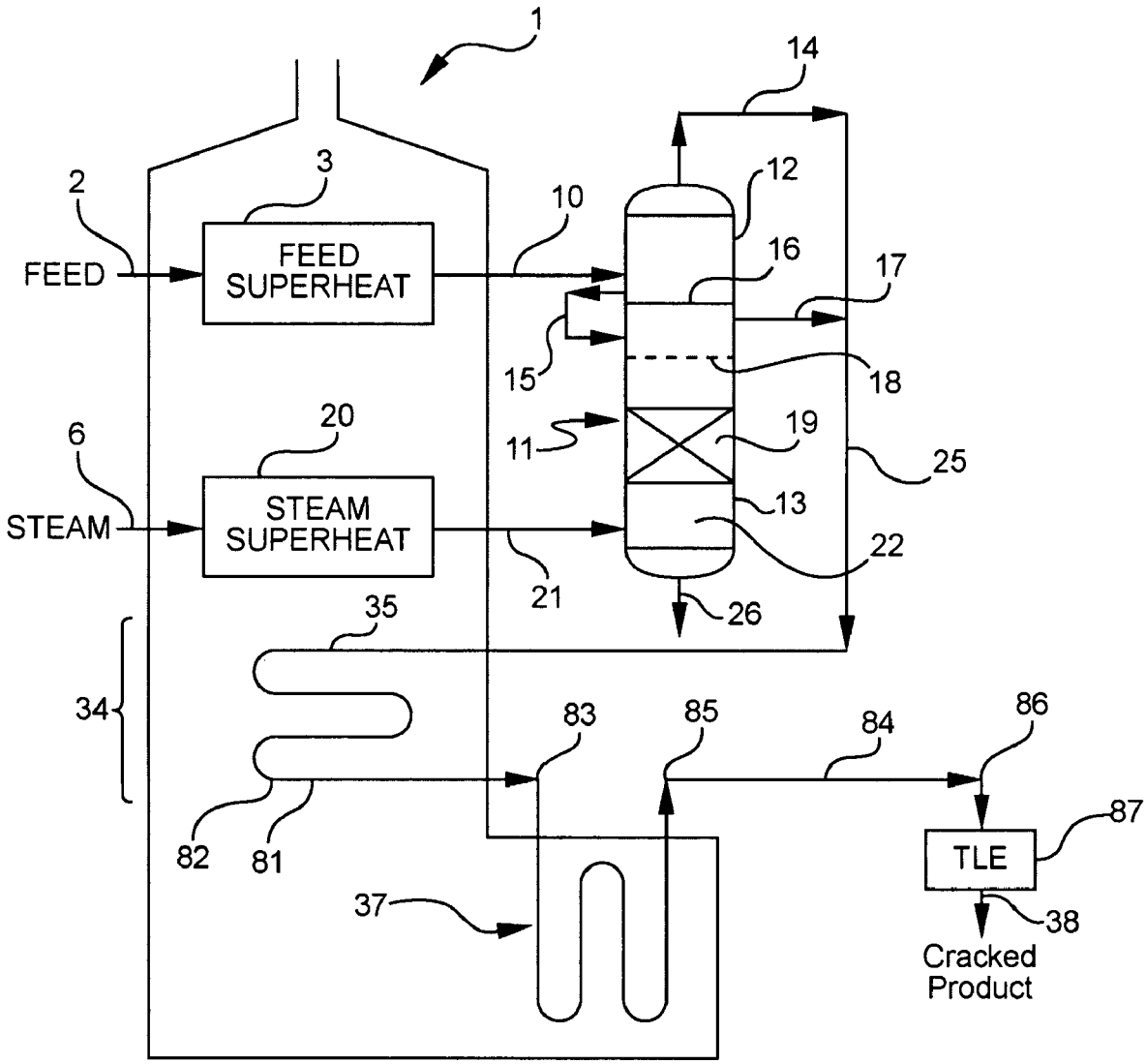
FIG. 1 Prior Art
FIG. 1 shows a simplified flow sheet for the whole crude oil/condensate cracking process described hereinabove.

The terms "hydrocarbon," "hydrocarbons," and "hydrocarbonaceous" as used herein do not mean materials strictly or only containing hydrogen atoms and carbon atoms. Such terms include materials that are hydrocarbonaceous in nature in that they primarily or essentially are composed of hydrogen and carbon atoms, but can contain other elements such as oxygen, sulfur, nitrogen, metals, inorganic salts, and the like, even in significant amounts.

The term "gaseous" as used in this invention means one or more gases in an essentially vaporous state, for example, steam alone, a mixture of steam and hydrocarbon vapor, and the like.

An olefin producing plant useful with this invention would include a pyrolysis (thermal cracking) furnace for initially receiving and thermally cracking the feed. Pyrolysis furnaces for steam cracking of hydrocarbons heat by means of convection and radiation, and comprise a series of preheating, circulation, and cracking tubes, usually bundles of such tubes, for preheating, transporting, and cracking the hydrocarbon feed. The high cracking heat is supplied by burners disposed in the radiant section (sometimes called "radiation section") of the furnace. The waste gas from these burners is circulated through the convection section of the furnace to provide the heat necessary for preheating the incoming hydrocarbon feed. The convection and radiant sections of the furnace are joined at the "cross-over," and the tubes referred to hereinabove carry the hydrocarbon feed from the interior of one section to the interior of the next.

In a typical furnace, the convection section can contain multiple sub-zones. For example, the feed can be initially preheated in a first upper sub-zone, boiler feed water heated in a second sub-zone, mixed feed and steam heated in a third sub-zone, steam superheated in a fourth sub-zone, and the final feed/steam mixture split into multiple sub-streams and preheated in a lower (bottom) or fifth sub-zone. The number of sub-zones and their functions can vary considerably. Each sub-zone can carry a plurality of conduits carrying furnace feed there through, many of which are sinusoidal in configuration. The convection section, operating at much less severe operating conditions than the radiant section, has heretofore not been a problem in respect of coke formation therein.

Cracking furnaces are designed for rapid heating in the radiant section starting at the radiant tube (coil) inlet where reaction velocity constants are low because of low temperature. Most of the heat transferred simply raises the hydrocarbons from the inlet temperature to the reaction temperature. In the middle of the coil, the rate of temperature rise is lower but the cracking rates are appreciable. At the coil outlet, the rate of temperature rise increases somewhat but not as rapidly as at the inlet. The rate of disappearance of the reactant is the product of its reaction velocity constant times its localized concentration. At the end of the coil, reactant concentration is low and additional cracking can be obtained by increasing the process gas temperature.

Steam dilution of the feed hydrocarbon lowers the hydrocarbon partial pressure, enhances olefin formation, and reduces any tendency toward coke formation in the radiant tubes.

Cracking furnaces typically have rectangular fireboxes with upright tubes centrally located between radiant refractory walls. The tubes are supported from their top.

Firing of the radiant section is accomplished with wall or floor mounted burners or a combination of both using gaseous or combined gaseous/liquid fuels. Fireboxes are typically under slight negative pressure, most often with upward flow of flue gas. Flue gas flow into the convection section is established by at least one of natural draft or induced draft fans.

Radiant coils are usually hung in a single plane down the center of the fire box. They can be nested in a single plane or placed parallel in a staggered, double-row tube arrangement. Heat transfer from the burners to the radiant tubes occurs largely by radiation, hence the thermo "radiant section," where the hydrocarbons are heated to from about 1,450 F to about 1,550 F and thereby subjected to severe cracking, and coke formation.

The initially empty radiant coil is, therefore, a fired tubular chemical reactor. Hydrocarbon feed to the furnace is preheated to from about 900 F to about 1,000 F in the convection section by convectional heating from the flue gas from the radiant section, steam dilution of the feed in the convection section, or the like. After preheating, in a conventional commercial furnace, the feed is ready for entry into the radiant section.

The cracked gaseous hydrocarbons leaving the radiant section are rapidly reduced in temperature to prevent destruction of the cracking pattern. Cooling of the cracked gases before further processing of same downstream in the olefin production plant recovers a large amount of energy as high pressure steam for re-use in the furnace and/or olefin plant. This is often accomplished with the use of transfer-line exchangers that are well known in the art.

With a liquid hydrocarbon feedstock downstream processing, although it can vary from plant to plant, typically employs an oil quench of the furnace effluent after heat exchange of same in, for example, the transfer-line exchanger aforesaid. Thereafter, the cracked hydrocarbon stream is subjected to primary fractionation to remove heavy liquids, followed by compression of uncondensed hydrocarbons, and acid gas and water removal therefrom. Various desired products are then individually separated, e.g., ethylene, propylene, a mixture of hydrocarbons having four carbon atoms per molecule, fuel oil, pyrolysis gasoline, and a high purity hydrogen stream.

FIG. 1 shows one embodiment of a cracking process that uses whole crude oil and/or condensate as the primary furnace feed since this is the more extreme of examples of processes that can lead to the formation of coke in the convection section of the furnace. FIG. 1 is very diagrammatic for sake of simplicity and brevity since, as discussed above, actual furnaces are complex structures.

FIG. 1 shows a conventional cracking furnace 1 wherein a crude oil/condensate primary feed 2 is passed in to an upper feed preheat sub-zone 3 in the upper, cooler reaches of the convection section of furnace 1. Steam 6 is also superheated in an upper level of the convection section of the furnace.

The pre-heated cracking feed stream is then passed by way of pipe (line) 10 to a vaporization unit 11 (fully disclosed in U.S. Pat. No. '961), which unit is separated into an upper vaporization zone 12 and a lower zone 13. Unit 11 achieves primarily (predominately) vaporization of at least a significant portion of the naphtha and gasoline boiling range and lighter materials that remain in the liquid state after the preheating step. Gaseous materials that are associated with the preheated feed as received by unit 11, and additional gaseous materials formed in zone 12, are removed from zone 12 by way of line 14. Thus, line 14 carries away essentially all the lighter hydrocarbon vapors, e.g., naphtha and gasoline boiling range and lighter, that are present in zone 12. Liquid distillate present in zone 12, with or without some liquid gasoline and/or naphtha, is removed there from via line 15 and passed into the upper interior of lower zone 13. Zones 12 and 13, in this embodiment, are separated from fluid communication with one another by an impermeable wall 16, which can be a solid tray. Line 15 represents external fluid down flow communication between zones 12 and 13. In lieu thereof, or in addition thereto, zones 12 and 13 can have internal fluid communication there between by modifying wall 16 to be at least in part liquid permeable by use of one or more trays designed to allow liquid to pass down into the interior of zone 13 and vapor up into the interior of zone 12. For example, instead of an impermeable wall 16, a chimney tray could be used in which case vapor carried by line 17 would pass internally within unit 11 down into section 13 instead of externally of unit 11 via line 15. In this internal down flow case, distributor 18 becomes optional.

By whatever way liquid is removed from zone 12 to zone 13, that liquid moves downwardly into zone 13, and thus can encounter at least one liquid distribution device 18. Device 18 evenly distributes liquid across the transverse cross section of unit 11 so that the liquid will flow uniformly across the width of the tower into contact with packing 19.

Dilution steam 6 passes through superheat zone sub-20, and then, via line 21 in to a lower portion 22 of zone 13 below packing 19. In packing, 19 liquid and steam from line 21 intimately mix with one another thus vaporizing some of liquid 15. This newly formed vapor, along with dilution steam 21, is removed from zone 13 via line 17 and added to the vapor in line 14 to form a combined hydrocarbon vapor product in line 25. Stream 25 can contain essentially hydrocarbon vapor from feed 2, e.g., gasoline and naphtha, and steam.

Stream 17 thus represents a part of feed stream 2 plus dilution steam 21 less liquid distillate(s) and heavier from feed 2 that are present in bottoms stream 26. Stream 25 is passed through a header (not shown) whereby stream 25 is split into multiple sub-streams and passed through multiple conduits which are not shown but are represented by single, upstanding (essentially vertical), sinusoidal conduit 35. Line 35 is in a lower, and therefore hotter, sub-zone 34 of the convection section of furnace 1. Sub-zone 34 is used for preheating stream 25 to a temperature, aforesaid, suitable for cracking in zone 37.

After substantial heating in conduit 35, stream 25 passes into radiant section 37 of furnace 1 by way of crossover line 81 which line can include one or more bend fittings such as elbow (90 degree) fittings 82 and 83. Again, the multiple, individual streams that normally pass by way of line 81 from sub-zone 34 to and through sub-zone 37 are represented as a single flow stream for sake of brevity.

In radiant firebox 37 of furnace 1, feed from line 35, which contains numerous varying hydrocarbonaceous components, is subjected to severe thermal cracking conditions as aforesaid. The cracked product from radiant section 37 passes out of furnace 1 by way of transfer line 84, which line can also include one or more bend fittings such as elbow fittings 85 and 86. Pipe 84 transfers the cracked product from furnace 1 to the transfer line exchanger (TLE) 87 at which point the multi-step temperature quenching (cooling) process of that product begins.

The cracked product leaves TLE 87 by way of line 38 for further processing in the remainder of the olefin plant downstream of furnace 1 as described hereinabove.

Feed 2 can enter furnace 1 at a temperature of from about ambient up to about 300 F at a pressure from slightly above atmospheric up to about 100 psig (hereafter "atmospheric to 100 psig"). Feed 2 can enter zone 12 via line 10 at a temperature of from about ambient to about 500 F at a pressure of from atmospheric to 100 psig.

Stream 14 can be essentially all hydrocarbon vapor formed from feed 2 and can be at a temperature of from about ambient to about 750 F at a pressure of from atmospheric to 100 psig.

Stream 15 can be essentially all the remaining liquid from feed 2 less that which was vaporized in pre-heater 3 and can be at a temperature of from about ambient to about 700 F at a pressure of from slightly above atmospheric up to about 100 psig (hereafter "atmospheric to 100 psig").

The combination of streams 14 and 17, as represented by stream 25, can be at a temperature of from about 170 to about 800 F at a pressure of from atmospheric to 100 psig, and contain, for example, an overall steam/hydrocarbon ratio of from about 0.1 to about 2, preferably from about 0.1 to about 1, pounds of steam per pound of hydrocarbon.

In zone 13, dilution ratios (hot gas/liquid droplets) can vary widely because the composition of condensate varies widely. Generally, the hot gas 21, e.g., steam, to hydrocarbon ratio at the top of zone 13 can be from about 0.1/1 to about 5/1, preferably from about 0.1/1 to about 1.2/1, more preferably from about 0.1/1 to about 1/1.

Steam is an example of a suitable hot gas introduced by way of line 21. Other materials can be present in the steam employed. Stream 6 can be that type of steam normally used in a conventional cracking plant. Such gases are preferably at a temperature sufficient to volatilize a substantial fraction of the liquid hydrocarbon 15 that enters zone 13. Generally, the gas entering zone 13 from conduit 21 will be at least about 350 F, preferably from about 650 to about 1,000 F at from atmospheric to 100 psig. Such gases will, for sake of simplicity, hereafter be referred to in terms of steam alone.

Stream 17 can be a mixture of steam and hydrocarbon vapor that has a boiling point lower than about 350 F. It should be noted that there may be situations where the operator desires to allow some distillate to enter stream 17, and such situations are within the scope of this invention. Stream 17 can be at a temperature of from about 170 to about 450 F at a pressure of from atmospheric to 100 psig.

Steam from line 21 does not serve just as a diluent for partial pressure purposes as is the normal case in a cracking. Rather, steam from line 21 provides not only a diluting function, but also additional vaporizing energy for the hydrocarbons that remain in the liquid state. This is accomplished with just sufficient energy to achieve vaporization of heavier hydrocarbon components and by controlling the energy input. For example, by using steam in line 21, substantial vaporization of feed 2 liquid is achieved. The very high steam dilution ratio and the highest temperature steam are thereby provided where they are needed most as liquid hydrocarbon droplets move progressively lower in zone 13.

Figure 2:
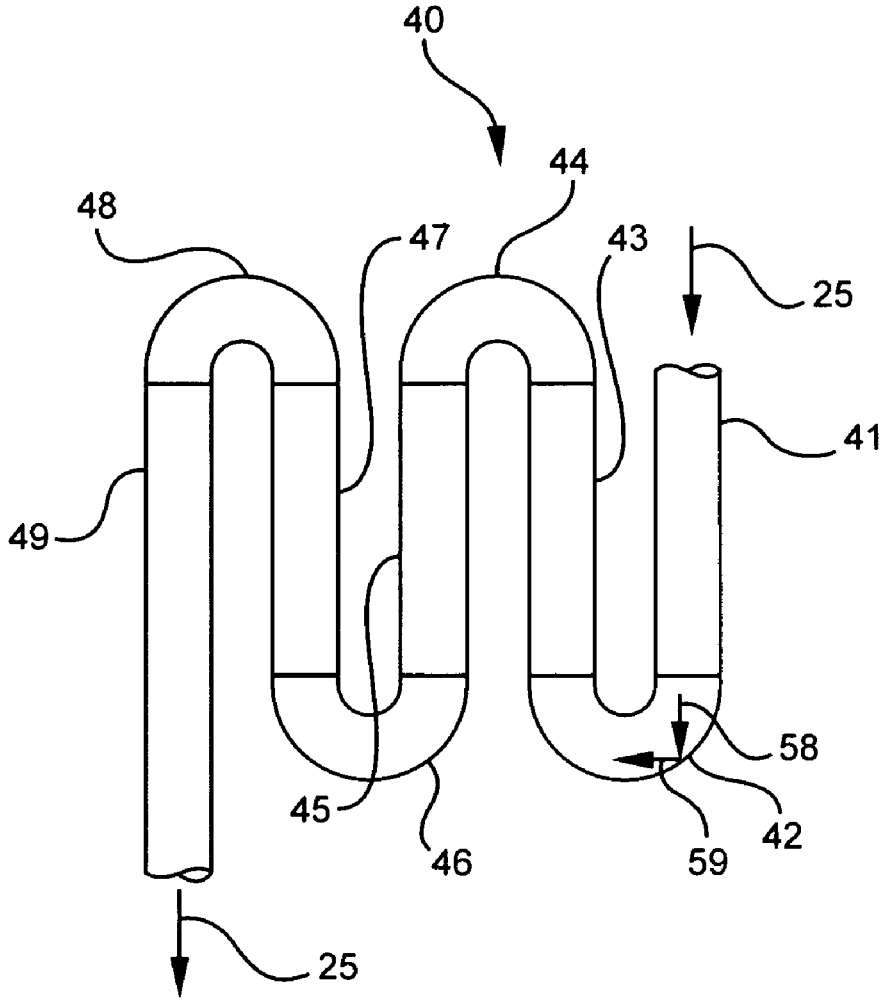
FIG. 2 Prior Art
FIG. 2 shows a section of a typical sinusoidal convection conduit as normally used in a cracking furnace.

FIG. 2 shows a portion 40 of convection section conduit 35. This portion is upstanding in furnace 1 as shown in FIG. 1, and is shown essentially horizontal in FIG. 2 for convenience sake only. Conduit portion 40 is sinusoidal in configuration and contains a plurality of essentially straight pipe sections 41, 43, 45, and 49 conjoined in fluid communication by spaced apart 180 degree u-tube (u-bend) fittings 42, 44, 46, and 48. Although this specific embodiment is described in respect of 180 degree turn fittings, it is equally applicable to 45 degree, 90 degree, etc. fittings. In operation, stream 25 passes through the hollow interior of conduit 48 at an elevated temperature and a high velocity, and makes a series of u-turns in fittings 42, 44, 46, and 48 as it passes through that conduit. Each time the direction of flow of stream 25 is redirected (arrows 58 and 59) by a fitting such as bend 42, it is accomplished by impingement of stream 25 on an interior surface of that fitting. This redirection of the flow direction of stream 25 by impingement on an inner surface of a fitting can cause erosion of that fitting if stream 25 carries, in addition to cracking feed, coke fines that have been formed upstream of conduit 48 in the convection section of the furnace, e.g., sections 3 and/or 11, FIG. 1.

Figure 3:
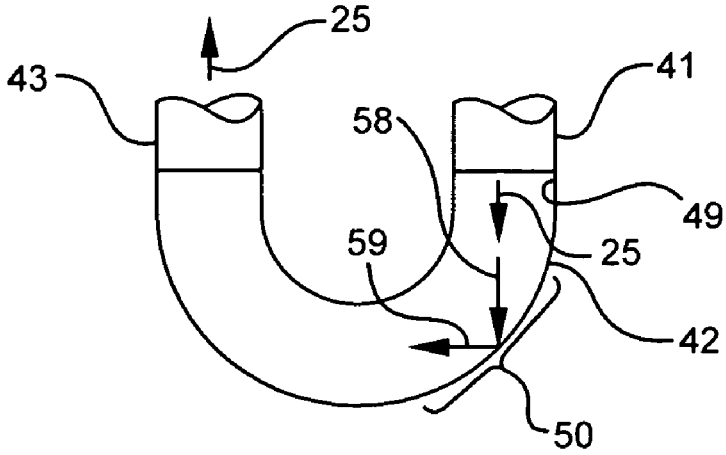
FIG. 3 Prior Art
FIG. 3 shows a 180 degree u-tube bend (fitting) used in the conduit of FIG. 2.

FIG. 3 shows an enlarged fitting 42 and further shows one example where coke impingement erosion could occur in the interior of that fitting. Area 50 on the interior surface 49 of that fitting is, in this example, the area of fitting 42 that is subject to erosion. If left unchecked, physical erosion in area 50 can cause sufficient loss of conduit wall material to thin that wall to an extent that one or more holes form through the conduit wall. This hole or holes can extend over all or any part of area 50. Perforation of one or more fittings in this manner can cause a shutdown of the furnace for repair, which is costly and time consuming.

Figure 4:
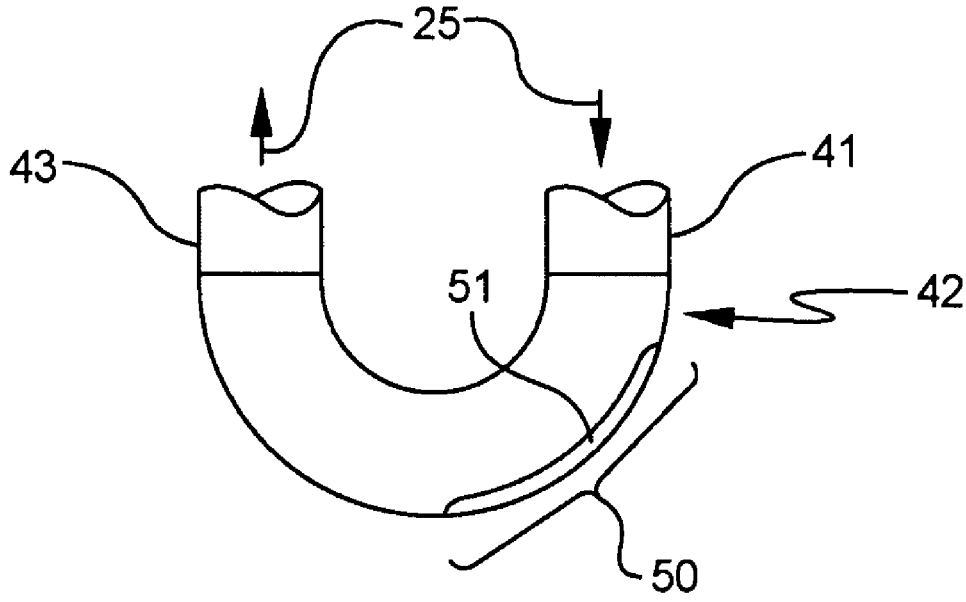
FIG. 4 shows the fitting of FIG. 3, and an area thereof that is subject to erosion by the impingement of coke carrying furnace feed thereon, which area has been protected in accordance with this invention.

FIG. 4 shows fitting 42 in the process of being provided with a protective member 51 pursuant to this invention, as described in greater detail hereinafter. Member 51 can be applied overall or essentially all of area 50 on inner surface 49 of fitting 42. It can also be applied over an area greater than area 50.

Figure 5:
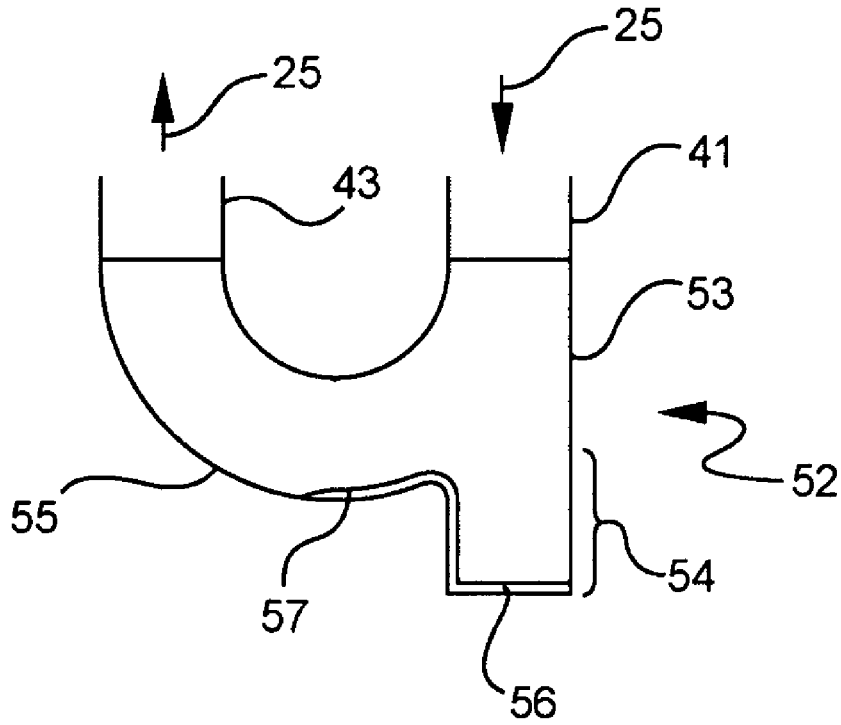
FIG. 5 shows a hybrid Tee-fitting that can be used in lieu of the fitting of FIG. 4.

FIG. 5 shows an alternative configuration 52 for u-fitting 42. Fitting 52 has an upstream leg 53 that carries an extension leg 54 joined to a u-extension leg 55, the overall combination of legs resembling a fitting that is roughly Tee-shaped. By use of this configuration, leg 54 bears the brunt of the erosive effect of stream 25, and thereby protects the remainder of the fitting. Pursuant to this invention, one or both of protective members 56 and 57, as described in greater detail hereinafter, can be applied to areas where erosion occurs inside fitting 52.

Figure 8:
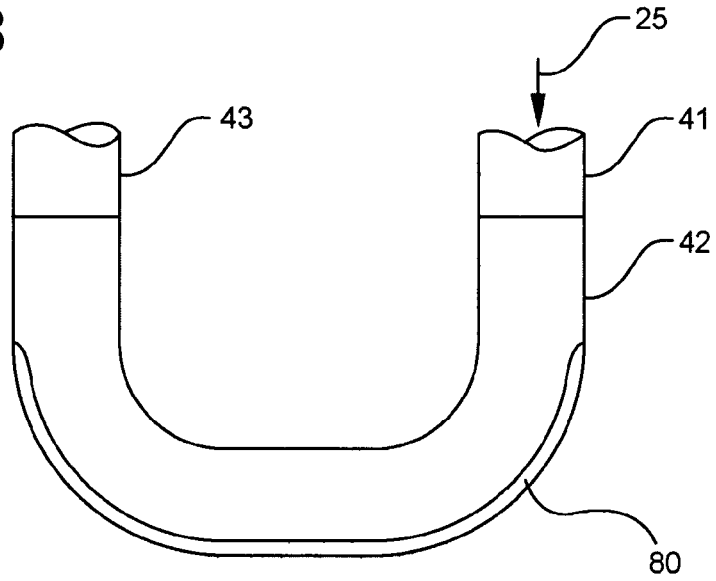
FIG. 8 shows one embodiment of a finished u-tube fitting which has been modified pursuant to this invention.
Figure 10:
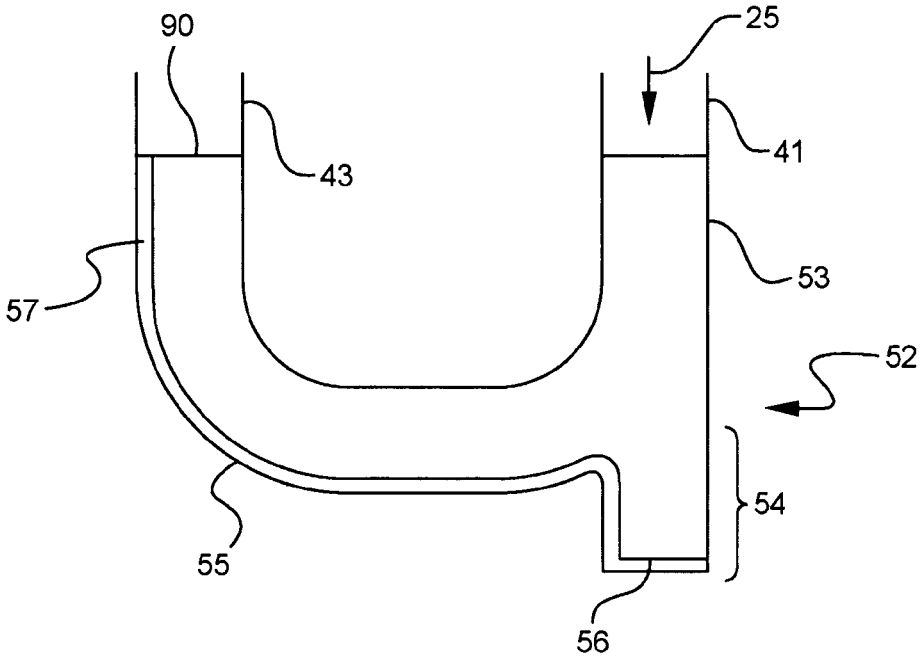
FIG. 10 shows an embodiment within this invention of a Tee-fitting that can be used in lieu of the fitting of FIG. 5.

Either one or both of cross-over bend fittings 82 and 83 and/or transfer line fittings 85 and 86 can, pursuant to this invention, be provided with a protective member like member 51 of FIG. 4, member 57 of FIG. 5, member 80 of FIG. 8, or member 57 of FIG. 10.

Cross-over fittings and transfer line fittings, like fittings 42 (FIGS. 4 and 8) and 52 (FIGS. 5 and 10) can be 45 degree, 90 degree, etc. bends in lieu of the 180 degree bend shown in the Figures.

This invention is applicable to either cast or forged fittings. For example, in FIGS. 4 and 5 fittings 42 and 52 can be manufactured either by casting or forging processes. The convection tubing, cross-over lines, and transfer lines, and their associated fittings, are typically formed from metal, usually steel.

Figure 6:
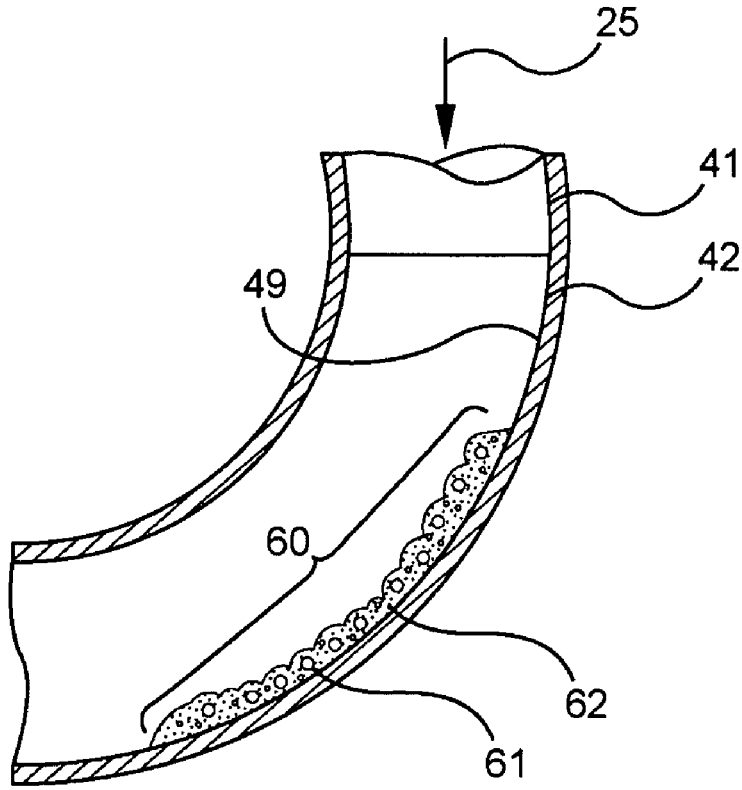
FIG. 6 shows in greater detail the section of the fitting of FIG. 4 that is in the process of being protected from erosion pursuant to this invention.

FIG. 6 shows the first step in the formation of hard facing protective members 51, 56, and 57. Protective members pursuant to this invention are usually applied in multiple individual passes of a metal inert gas (MIG) welding machine. FIG. 6 shows the first overlay 60 that is employed in forming the protective members of this invention. In this embodiment overlay 60 is shown to cover essentially all of area 50 of FIG. 4, but this is not required, covering more or less of area 50 being within the scope of this invention.

First overlay 60 can be applied by an MIG welding machine, but other known techniques such as plasma arc welding can be used to apply overlay 50. When MIG welding is employed, for example, the process is started with the gas blanketed electrode consisting of a mild steel wire forming a puddle at one end of the area to be covered. The welding is continued and cemented metal carbide pellets 61 are poured into the weld puddle formed by the electrode.

In FIG. 6, first overlay 60 is shown to by located on the inner surface 49 of fitting 42. Overlay 60 is comprised of cemented metal carbide pellets 61 in mild steel 62. Pellets 61 can, for example, be sintered tungsten carbide particles cemented with cobalt or other suitable metallic binder. Alternative carbide pellet compositions include cemented nickel-tungsten carbide and cemented nickel-chromium-tungsten carbide. The hard metal particles in cemented metal carbide pellets 61 can range in size from large sintered particles to submicron particles cemented with a metallic binder such as cobalt. Submicron grain hard metal particles in pellets 61 can improve binding among the hard metal particles, carbon and steel in the surface 49 of fitting 42, and enhance the erosion resistance of surface 49.

Although not so limited, for sake of brevity, the formation of the protective member of this invention will be directed to cemented metal carbide pellets that are sintered tungsten carbide cemented with cobalt.

The percentage of the tungsten carbide in pellets 61 can exceed 80 wt. %. The cobalt binder in pellets 61 can account for between 6 and 29 wt. % of the pellet composition. Pellets 61 can also include minor amounts of iron, titanium, tantalum, and vanadium, and the amount of these additional elements should not exceed 2 wt. % of the pellet's composition. The ultimate hardness of protective members 51, etc., can be adjusted by varying the concentration of hard metal particles relative to the concentration of binder in the pellet.

The percentage of pellets 61 in first overlay 60 can range from about 40 wt. % to about 65 wt. %, while the mild steel 62 will account for from about 35 to about 60 wt. %. The size of pellets 61 can range from 8/16 down to 80/200 based on the distribution of the average particle size according to U.S. standard sieve screen measures, preferably from about 10 to about 24 mesh.

Each pass of the electrode along a portion of surface 63 to be protected can be about 3/32 of an inch thick and about 3/4 of an inch wide. After the desired portion of area 50 has been covered with first overlay 60, a second overlay is applied over first overlay 60.

Figure 7:
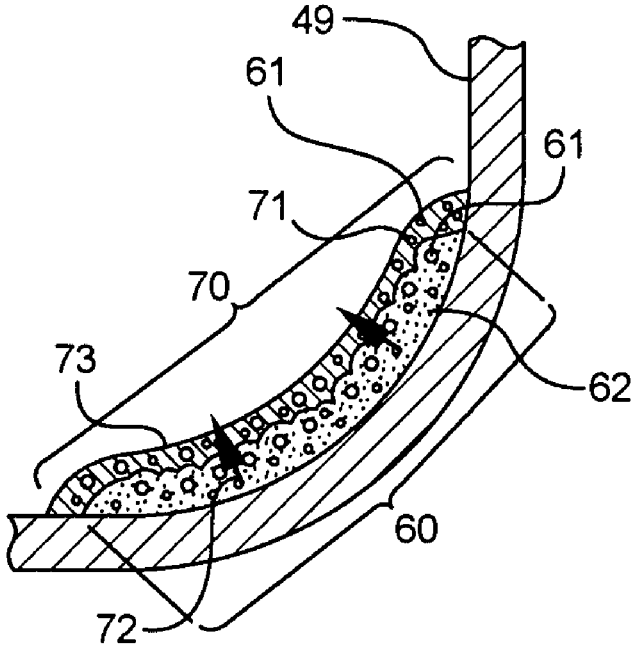
FIG. 7 shows the section of FIG. 6 further into the process of being protected pursuant to this invention.

FIG. 7 shows the step of applying the second overlay 70. Unlike first overlay 60, second overlay 70 must be applied using MIG welding or similar heat process. Second overlay 70 is composed of mild steel 71, and does not initially contain any cemented metal carbide pellets 61 dispersed therein. Overlay 70 is laid down on overlay 60 using MIG welding as described for overlay 60. As shown in FIG. 7, during the application of overlay 70, a portion of overlay 60 is melted and is mixed into the weld puddle of the second overlay. Due to differences in concentration, the hard metal particles 61 from overlay 60 diffuse and disperse throughout the weld puddle and solidify in overlay 70 as it cools. MIG welding of overlay 70 and the resulting diffusion of hard metal particles 61 creates enhanced bonding between the materials in overlay 70 as well as between overlays 60 and 70. Little or no delineation between the two overlays will be seen visually.

Arrows 72 in FIG. 7 illustrate the direction of the migration of the hard metal particles 61 into overlay 70 of mild steel 71, and toward the external surface 73 of member 51 in the interior of fitting 42. As overlay 70 solidifies, the dispersed hard metal particles 61 in that overlay alloy with the mild steel 71. The migration of particles 61 from the first to the second overlay and their bonding with the steel ultimately forms a steel hybrid matrix that is protective of members 51, etc., the matrix being, for example, of tungsten, carbon and steel.

Additional MIG overlays can be employed if desired, the concentration of hard metal particles in each succeeding layer being progressively reduced. After the application of overlay 70, the fitting can, if desired, be machined using conventional techniques such as grinding to the desired final dimensions for members 51, 56, 57, or 80.

The process for forming the types of overlay protective members described hereinabove is known in the art, and fully and completely disclosed in U.S. Pat. No. 6,117,493 issued to Robert B. North, the disclosure of which is incorporated herein by reference.

FIG. 8 shows one embodiment of a finished fitting of this invention that carries a protective member 80 that comprises a steel carrier carrying carbide pellets composed of hard particles cemented with a metal binder. In this example, member 80 extends for the full 180 turning radius of fitting 42, although this extent of coverage is not required to obtain the benefits of this invention.

Figure 9:
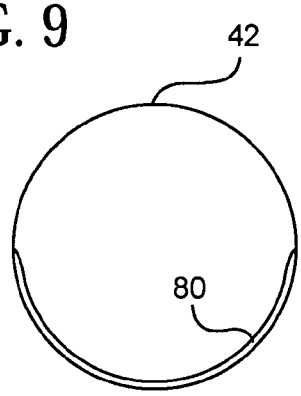
FIG. 9 shows a transverse cross-section of the fitting of FIG. 8.

FIG. 9 shows member 80 extending transversely for essentially the 180 degree lower half of fitting 42. Different extents of lateral (transverse) coverage of member 42, less than or greater than the 180 degrees shown in this Figure, can be employed and are within the scope of this invention. Similar reasoning applies to the lateral coverage of protective members 51 (FIG. 4) and 57 (FIGS. 5 and 10).

FIG. 10 shows an alternative to fitting 52 of FIG. 5 wherein protective member 57 is extended, pursuant to this invention, essentially to the outlet end 90 of that fitting.

EXAMPLE

A natural gas condensate stream 5 characterized as Oso condensate from Nigeria is removed from a storage tank and fed directly into the convection section of a pyrolysis furnace 1. This feed is at ambient conditions of temperature and pressure. In this convection section, this condensate initial feed is preheated to about 350 F at about 60 psig, and then passed into a vaporization unit 11 wherein a mixture of gasoline and naphtha gases at about 350 F and 60 psig are separated from distillate liquids in zone 12 of that unit.

The separated gases are removed from zone 12 for transfer to the convection preheat sub-zone 34 of the same furnace, which sub-zone employs a plurality of sinusoidal conduits 35, each containing u-fittings essentially in the form shown in FIG. 8. Upon leaving conduits 40, the preheated stream is passed to radiant section 37.

The hydrocarbon liquid remaining from feed 2, after separation from accompanying hydrocarbon gases aforesaid, is transferred to lower section 13 and allowed to fall downwardly in that section toward the bottom thereof. Preheated steam 21 at about 1,000 F is introduced near the bottom of zone 13 to give a steam to hydrocarbon ratio in section 22 of about 0.5. The falling liquid droplets are in counter current flow with the steam that is rising from the bottom of zone 13 toward the top thereof. With respect to the liquid falling downwardly in zone 13, the steam to liquid hydrocarbon ratio increases from the top to bottom of section 19.

A mixture of steam and naphtha vapor 17 at about 340 F is withdrawn from near the top of zone 13 and mixed with the gases earlier removed from zone 12 via line 14 to form a composite steam/hydrocarbon vapor stream 25 containing about 0.5 pounds of steam per pound of hydrocarbon present. This composite stream is passed through a plurality of sinusoidal conduits 35 to be preheated to about 1,000 F at less than about 50 psig, and then passed into radiant firebox 37 for cracking at a temperature in the range of 1,450° F. to 1,550° F.

Bottoms product 26 of unit 11 is removed at a temperature of about 460 F, and pressure of about 60 psig, and passed to an atmospheric distillation unit.

We claim:

1. In a thermal cracking process wherein a hydrocarbonaceous feed is to be cracked in a furnace having a convection zone and a radiant zone, said hydrocarbonaceous feed being of a chemical nature that tends to form coke in said convection zone, said convection zone containing at least one of (1) at least one sinusoidal conduit for conducting said feed through said convection zone, (2) at least one cross-over conduit, and (3) at least one transfer conduit, at least one of said sinusoidal convection conduit, cross-over conduit, and transfer conduit containing at least one bend filling having an interior surface that is exposed to said feed and erosion there from as said feed passes there through, the improvement comprising at least one of said bend fittings having over at least a portion of said interior surface that is subject to erosion at least one layer of hard facing comprising a steel carrier and carbide pellets composed of submicron hard particles cemented with a metal binder.

2. The process of claim 1 wherein said at least one bend filling has at least one of a 45 degree, 90 degree, and 180 degree turning radius.

3. The process of claim 1 wherein at least one of said bend fillings is a 180 degree turning radius fitting (52) that has an essentially straight extension leg (54) on its upstream side.

4. The process of claim 1 wherein said hydrocarbonaceous feed is at least one of a heavy crude oil fraction, whole crude oil, and natural gas condensate.

5. The process of claim 1 wherein said hydrocarbonaceous feed is subjected to a vaporization process before being passed into said at least one sinusoidal conduit.

6. The process of claim 1 wherein said sinusoidal conduit, cross-over conduit, and transfer conduit are formed of metal.

* * * * *